United States Patent [19]

Nieuwendijk et al.

[11] Patent Number: 4,547,631

[45] Date of Patent: Oct. 15, 1985

[54] LARGE-EXCURSION ELECTROACOUSTIC TRANSDUCER

[75] Inventors: Joris A. M. Nieuwendijk; Georgius B. J. Sanders; Cornelis D. van Dijk; Adrianus J. M. Kaizer, all of Eindhoven, Netherlands

[73] Assignee: U.S. Philips Corporation, New York, N.Y.

[21] Appl. No.: 501,310

[22] Filed: Jun. 6, 1983

[30] Foreign Application Priority Data

Jun. 23, 1982 [NL] Netherlands ..... 8202529

[51] Int. Cl.[4] ..... H04R 9/04

[52] U.S. Cl. ..... 179/115.5 R; 179/115.5 PC; 179/115.5 VC

[58] Field of Search ..... 179/115.5 R, 115.5 PC, 179/115.5 VC, 115.5 ME; 181/172, 161

[56] References Cited

U.S. PATENT DOCUMENTS

| | | | |
|---|---|---|---|
| 1,551,105 | 8/1925 | Haues | 181/161 |
| 1,679,194 | 7/1928 | Widmann | 181/161 |
| 1,823,512 | 9/1931 | Ringel | 181/161 |
| 1,844,605 | 2/1932 | Seabert | 181/161 |
| 3,185,767 | 5/1965 | Olson | 179/115.5 VC |
| 3,578,921 | 5/1971 | Knauert | 179/110 A |
| 3,947,647 | 3/1976 | Swinehart | 179/110 A |
| 4,246,447 | 1/1981 | Vorie | 179/110 A |
| 4,345,118 | 8/1982 | Takemura | 179/110 A |
| 4,379,952 | 4/1983 | Kaizer | 179/115.5 PC |
| 4,387,275 | 6/1983 | Shimada | 179/115.5 PC |

FOREIGN PATENT DOCUMENTS

| | | | |
|---|---|---|---|
| 253529 | 10/1926 | United Kingdom | 181/161 |

*Primary Examiner*—Gene Z. Rubinson
*Assistant Examiner*—L. C. Schroeder
*Attorney, Agent, or Firm*—Robert T. Mayer; Bernard Franzblau

[57] ABSTRACT

An electroacoustic transducer comprises a diaphragm (1), a magnet system (4) and a voice coil (3) arranged on a voice-coil former (2) in an air gap (5) of the magnet system. The movement is transmitted between the voice-coil former and the diaphragm via a lever mechanism comprising n lever devices (6) arranged at an angle relative to each other ($n \geqq 2$). A lever device (6) comprises a lever arm (9) coupled to a fulcrum (11) at the location of a first position (10) on the lever arm, to the voice-coil former (2) at the location of a second position (13), and to the diaphragm (1) at the location of a third position (14). The lever mechanism multiplies the excursion of the voice-coil former by a factor greater than unity. This results in an electroacoustic transducer with a long stroke which provides large excursions of the diaphragm. The lever mechanism may also be employed in other types of transducer, such as piezoceramic transducers. A compliant element (25) formed as a zigzag bellows secured both to the outer circumference of the diaphragm and to the chassis (26) to permit the large excursion of the diaphragm, is constructed so as to reduce the acoustic contribution of the compliant element to the transducer output signal, which contribution forms a distortion component in the output signal.

22 Claims, 8 Drawing Figures

LARGE-EXCURSION ELECTROACOUSTIC TRANSDUCER

The invention relates to an electroacoustic transducer provided with a diaphragm and an electromechanical actuator, the electromechanical actuator being coupled to the diaphragm via a lever mechanism for transmitting motion from the electromechanical actuator to said diaphragm.

Such transducers are, for example, piezo-ceramic transducers, the electromechanical actuator being a piezo-ceramic element. Other transducers are for example electrodynamic transducers. The electro-mechanical actuator then comprises a magnet system and a voice coil arranged on a voice-coil former with the voice coil disposed in an air gap of the magnet system. The last-mentioned transducer is described in the book "Loudspeakers" by N. W. Mc. Lachlan, Oxford at the Clarendon Press, 1934, pages 225 and 226. The lever device described in this book serves to increase the maximum excursion between the actuator and the diaphragm. A disadvantage of the known transducers comprising a lever device is that they produce an output signal with a substantially high distortion. The known transducer may cease to perform satisfactorily in the long run.

It is an object of the invention to provide a transducer which produces an output signal with a lower distortion and which has a longer operating life. To this end the electroacoustic transducer in accordance with the invention is characterized in that the lever mechanism comprises n lever devices arranged at an angle relative to each other or relative to the central axis of the transducer ($n \geqq 2$, said angle being smaller than 180° for $n=2$ and being preferably equal to 360°/n for $n \geqq 3$).

The invention is based on the recognition that the centring of the various moving parts in an electroacoustic transducer with a lever device is not satisfactory. The centering means known until now, such as centring rings (or spiders) in the known transducer generally do not provide a satisfactory centring. As a result of this unsatisfactory centring the voice coil in, for example, an electrodynamic transducer may become offcentered in the air gap. In the long run this may even lead to the voice coil breaking down. The transducer is then unserviceable.

When the transmission is realized by means of at least two lever devices only one degree of freedom is left, i.e. only a movement in the direction of excursion of the diaphragm. This has the advantage that it is no longer necessary to provide a special centring, for example by means of centring rings, so that the customary centring rings may be dispensed with. Moreover, especially in the case of flat-diaphragm transducers, this step has the advantage that the compliant element, which is secured to the diaphragm circumference and to the transducer chassis and which normally has both a centring function and an air-sealing function, no longer needs to perform a centring function but merely serves to provide air-sealing. As a result of this, the requirements imposed on the compliant element may be less stringent. However, the foregoing applies only if the lever devices behave as virtually ideal devices. This is the case if each lever device moves substantially in an associated plane.

An embodiment of the electroacoustic transducer in accordance with the invention which is provided with an electromechanical actuator in the form of a magnet system and a voice-coil arranged on a voice-coil former, which voice-coil is disposed in an airgap of the magnet system, is characterized in that a lever device comprises a lever arm which is coupled to a fulcrum at the location of a first position on the lever arm, to the voice-coil former at the location of a second position on the lever arm and to the diaphragm at the location of a third position on the lever arm.

When the distance between the first and the third position on the lever arm is selected to be greater than the distance between the first and the second position on the lever arm it is possible to obtain a diaphragm excursion which is greater than the excursion of the voice-coil former. Generally, the first position on the lever arm will be situated at the location of or near the one end of the lever arm. The third position may be situated for example at the location of or near the other end of the lever arm. The second position is then situated between the first and the third position. However, conversely, the second position may be situated at the location of or near the other end of the lever arm and the first position between the second and the third position.

A first preferred embodiment of the electroacoustic transducer in accordance with the invention is characterized in that the lever arm is coupled to the fulcrum at the location of the first position via a first pivotal element, to the voice-coil former at the location of the second position via a second pivotal element, a first rod and a third pivotal element, and to the diaphragm at the location of the third position via a fourth pivotal element, a second rod and a fifth pivotal element. A second preferred embodiment is characterized in that at the location of the third position the lever arm is coupled to the diaphragm via a first pivotal element, to the voice-coil former at the location of the second position via a second pivotal element, a first rod and a third pivotal element, and to the fulcrum at the location of the first position via a fourth pivotal element, a second rod and a fifth pivotal element. In the first preferred embodiment the second rod is situated between the lever arm and the diaphragm and consequently performs a translational movement corresponding to the translation (i.e. the excursion) of the diaphragm. The moving mass of the transducer is then substantially equal to the sum of the weight of the diaphragm, the weight of the second rod and the weight of the voice-coil former and the voice coil. In the second preferred embodiment, however, the second rod is secured to the fulcrum via a pivotal element. As a result of this, the second rod does not perform a translational movement but a rotational movement only. Consequently, the moving mass of the transducer is then reduced. In the case of equal weights of the corresponding parts the second preferred embodiment will therefore have a higher electroacoustic conversion efficiency.

Both embodiments have the advantage that the point where the lever device acts on the diaphragm performs a movement along a substantially straight line which extends in a direction which corresponds to the desired direction of movement of the diaphragm. This is not the case in the known lever device. Said point then moves along a circularly curved line, i.e. also in a direction perpendicular to the desired direction of movement of the diaphragm, which gives rise to additional distortion.

Moreover, in the second preferred embodiment the first, the second and the fourth pivotal elements and the first, the third and the fifth pivotal elements respectively will be arranged in line. This results in an exactly linear enlargement of the excursion of the voice-coil former and the diaphragm, so the lever mechanism hardly contributes to the distortion in the transducer output signal. The pivotal elements may be plate springs and/or cross-spring pivots, but preferably at least the first, the second and the fourth pivotal elements will be constructed as cross-spring pivots.

The third and the fifth pivotal elements need only be capable of rotating through a small angle so that in this case plate springs provide a satisfactory solution. However, the first, the second and the fourth pivotal element should be capable of rotating through a larger angle, so that here plate springs are less suitable. Preferably, cross-spring pivots will be used because they retain their spring characteristics through a wider angle. The fulcrum may be situated inside the voice-coil former or inside a notional extension of the voice-coil former and may be coupled to that part of the magnet system which is disposed inside the voice-coil former. The fulcrum may then be common to all lever devices.

In general the compliant element which is secured both to the outer circumference of the diaphragm and to the transducer chassis should meet a number of requirements. Firstly, the compliant element has a centring function. Furthermore, the compliant element has an air-sealing function, namely to prevent an acoustic shortcircuit between the front and the rear of the diaphragm when the transducer is incorporated in a baffle.

In all cases the compliant element should of course be capable of handling the maximum excursion of the diaphragm. FIG. 7.1 in the book "Acoustics" by L. L. Beranek shows a compliant element designated 2. This compliant element generally allows a limited excursion only so that in most cases such a compliant element is not suitable for use in large-excursion electroacoustic tranducers. This is because the non-linear behaviour of the compliant element, especially at large excursions, causes a high distortion in the output signal of the transducer. U.S. Pat. No. 3,019,849 (see FIG. 1) proposes a compliant element which permits a larger excursion of the diaphragm. This compliant element is constructed as a zigzag bellows. Nevertheless, the transducer described in said United States Patent is found to produce an output signal with a high degree of distortion.

In order to preclude this, the acoustic transducer, which is provided with a compliant element which is secured both to the outer circumference of the diaphragm and to a chassis of the transducer and which is constructed as a zigzag bellows, is characterized in that at the location of a number of identical cross-sections perpendicular to the direction of movement of the diaphragm the bellows is provided with stiffening means for keeping said cross-sections at least substantially constant, even during an excursion of the diaphragm.

This step is based on the recognition that in electroacoustic transducers as known from said United States Patent the compliant element contributes to the acoustic output signal of the transducer. This contribution is undesirable and manifests itself as a distortion in the output signal.

The explanation for this contribution is as follows. A (for example) sinusoidal vibration of the diaphragm causes the zigzag bellows to expand and subsequently to contract. During expansion and contraction of the bellows the pressure in the bellows decreases and increases respectively, so that the bellows become thinner and thicker respectively. This results in an acoustic radiation from the bellows surface. As already stated, this radiation is undesirable because the acoustic radiation (the output signal) of the transducer should be produced by the diaphragm only.

The stiffening means now at least largely prevent the bellows from becoming thinner or thicker during expansion and contraction respectively. Thus, said acoustic contribution of the bellows and consequently the distortion in the output signal of the transducer can be reduced.

The stiffening means may comprise, for example, stiff rings which are each arranged on (in) the bellows at the location of one of the said cross-sections.

It is evident that the use of such bellows, in particular in large-excursion transducers provided with the lever mechanism in accordance with the invention, is very effective. The choice of the location where the stiffening means are arranged on (in) the bellows is mainly dictated by the location (the lines) where the bellows is secured to the diaphragm and the chassis respectively. The circumferential length of these lines along which the bellows is secured to the diaphragm and the chassis remains the same, even during an excursion of the diaphragm, so that for determining the location of the stiffening means preferably those cross-sections are taken which correspond to (whose circumferential length is equal to the circumferential length of) these lines. Thus, the stiffening means may be arranged at the location of those cross-sections having the greatest circumferential length when the diaphragm performs no excursion.

A further reduction of the acoustic power radiated by the bellows can be achieved when, for each fold of the bellows, the portions of the bellows lying on either side thereof are at an angle $\alpha$ relative to each other. The said angle is at least substantially equal to 90° in the non-deflected condition of the diaphragm, while suitably in any deflected condition of the diaphragm the angle which said two portions make with each other is always between 90° and 120°.

The invention will now be described in more detail, by way of example, with reference to the drawings in which.

Figure 1A:
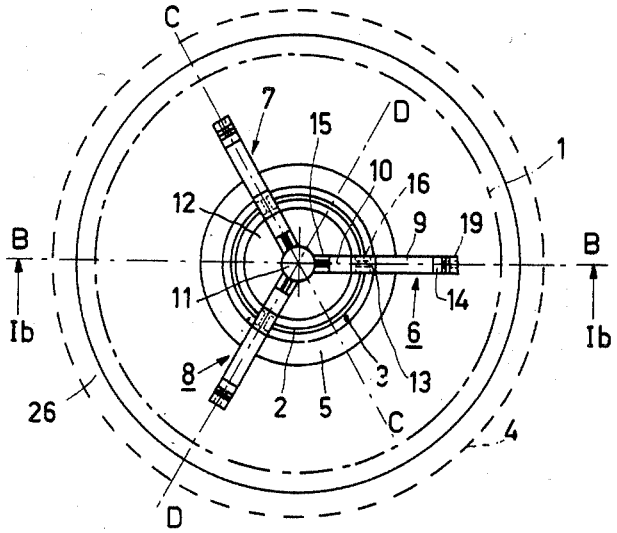
FIG. 1 shows a first embodiment of an electroacoustic converter equipped with a lever mechanism, FIG. 1*a* being a plan view of the transducer from which the diaphragm and the compliant element have been removed, FIG. 1*b* being a sectional view, and FIG. 1*c* showing a lever device in the deflected condition of the diaphragm.
Figure 1B:
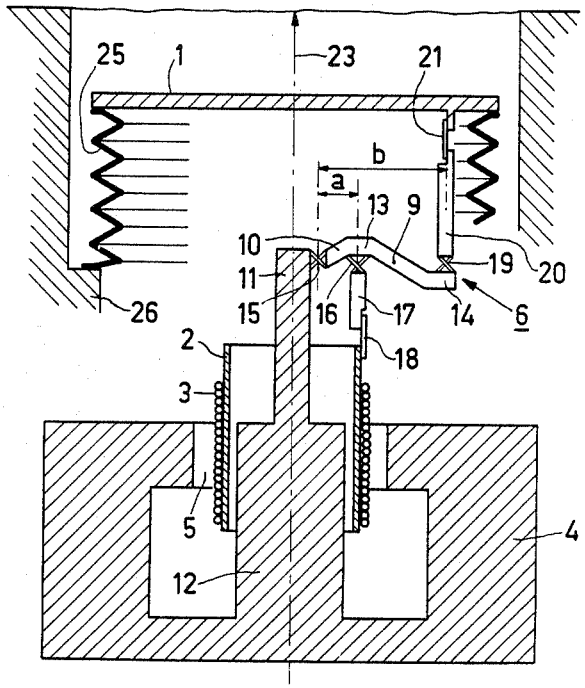

FIG. 1*a* is a plan view of a first embodiment of the transducer in accordance with the invention, from which the diaphragm and the compliant element 25 have been removed. In FIG. 1*a* the diaphragm 1 is represented by a broken line. FIG. 1*b* is a sectional view taken on the line B—B in FIG. 1*a*. The transducer comprises a magnet system 4 and a voice-coil 3 arranged on a voice-coil former 2 and mounted in an air gap 5 of the magnet system 4. The motion is transmitted between the voice-coil former and the diaphragm via a lever device.

Figure 1C:
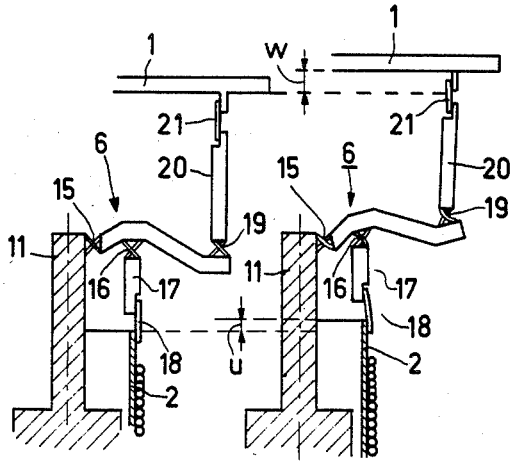

The transducer shown in FIGS. 1a–1c comprises three lever devices 6, 7 and 8, which are arranged at an angle relative to each other.

Figure 1D:
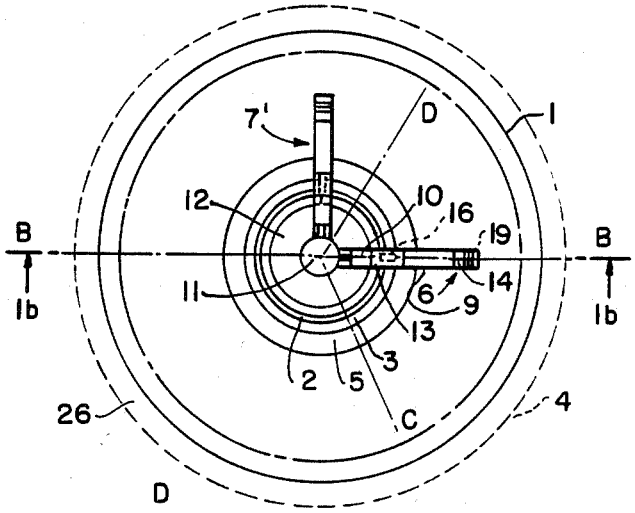

In principle, it would be adequate to use two lever devices 6 and 7' arranged at an angle smaller than 180°, for example, 90°, relative to each other as shown in FIG. 1d. However, since the lever devices always exhibit some transverse movement (for example as a result of the non-ideal behaviour of the pivotal elements to be described hereinafter), the use of three or more lever devices is preferred in order to obtain an optimum positioning of the voice-coil former 2 within the air gap 5. The angle at which the lever devices are arranged relative to each other is preferably 360°/n, n being the number of lever devices. FIG. 1b shows three lever devices which are arranged at angles of 120° relative to each other.

A lever device, as indicated by the reference numeral 6 in FIGS. 1a and 1b, comprises a lever arm 9 which is coupled to a fulcrum 11 at the location of a first position 10 on the lever arm. The fulcrum 11 is situated within the extension of the voice-coil former 2 and is secured to that part 12 of the magnet system 4 which is situated inside the voice-coil former 2. FIG. 1a shows that the fulcrum 11 is common to the three lever devices 6, 7 and 8. At the location of a second position 13 on the lever arm 9 the lever arm is coupled to the voice-coil former and at the location of a third position 14 it is coupled to the diaphragm 1. Coupling to the fulcrum 11 is effected by means of a first pivotal element 15. Coupling to the voice-coil former is effected via a second pivotal element 16, a first rod 17 and a third pivotal element 18, and coupling to the diaphragm 1 via a fourth pivotal element 19, a second rod 20 and a fifth pivotal element 21. The lever device 6 as shown in FIG. 1a is movable in a plane which is defined by the line B—B and which is perpendicular to the plane of drawing of FIG. 1a. In FIG. 1b this plane, as can be seen in FIG. 1c, corresponds to the plane of the drawing. The lever devices 7 and 8 as shown in FIG. 1a are movable in a plane defined by the line C—C and D—D respectively, which plane is also perpendicular to the plane of the drawing of FIG. 1a.

The pivotal elements 15, 16, 18, 19 and 21 may be constructed as plate springs or as cross-springs pivots. During an excursion of the diaphragm the pivotal elements 18 and 21 rotate through such a small angle that plate springs may be used for these pivotal elements. However, the pivotal elements 15, 16 and 19 rotate through a substantially greater angle so that here the use of cross-spring pivots is preferred. In a preferred embodiment comprising two lever devices, however, at least one lever device will comprise only cross-spring pivots in order to obtain a maximum resistance to torsional movements for the assembly, i.e. in order to minimize a rotation of the assembly. For a discussion of the theory and the use of plate springs and cross-spring pivots reference is made to the following publications:

i J. van Eijk, J. F. Dijksman: "Kruisveerscharnieren", in "de Constructeur" of August 1981, pages 16–21.

ii J. F. Dijksman: "A study of some aspects of the mechanical behaviour of cross-spring pivots and plate spring mechanism with negative stiffness", dissertation Delft Technical University, WT-TH, report number 116.

iii R. Breitinger: "Lösungskataloge für Sensoren", part 1, Krauskopf Verlag, Mainz 1976.

Moreover, publication ii contains a list of some thirty references.

If the distance between the pivotal elements 15 and 16 and between the pivotal elements 15 and 19 is a and b respectively, the excursion w of the diaphragm in the case of a displacement u of the voice-coil former is equal to u·(b/a), so that the diaphragm excursion is enlarged by a factor (b/a). This is illustrated in FIG. 1c, in which the lever device 6 is shown in a deflected condition of the voice-coil former 2 and the diaphragm 1. The excursion u of the voice-coil former 2 and the excursion w of the diaphragm 1 relative to the respective neutral positions is clearly visible, w being greater than the displacement u of the voice-coil former as a result of the transmission via the lever device 6. Moreover, it is clearly visible that the pivotal elements 15, 16 and 19 are rotated through a greater angle than the pivotal elements 18 and 21.

The very effective rectilinear guidance provided by the lever devices ensures that the point where the lever device 6 acts on the diaphragm, i.e. the location of the pivotal element 21, moves along a substantially straight line which extends in a direction corresponding to the central axis 23 (and hence corresponding to the desired direction of movement of the diaphragm 1).

It is obvious that the lever devices 7 and 8 are constructed in the same way and operate in the same way as described in the foregoing for the lever device 6.

The transducer shown in FIG. 1 has a flat diaphragm. This is not necessary. Other diaphragm shapes are also possible, such as dome-shaped or cone-shaped diaphragms. Moreover, the diaphragm need not necessarily be circular. For example, square, rectangular or oval diaphragms may also be used. The arrangement of the lever devices 6, 7 and 8 ensures that the voice coil, voice-coil former and diaphragm are centred and can only move in a direction corresponding to the central axis 23. As a result of this the voice-coil former need no longer be centred, i.e. a centring ring is not necessary. The foregoing is valid only in the case of an ideal behaviour of the pivotal elements: i.e. these elements should have a high transverse stiffness so that the lever devices 6, 7 and 8 only move in corresponding planes defined by the respective lines B—B, C—C and D—D and perpendicular to the plane of the drawing in FIG. 1a. In the case of a non-ideal behaviour of the pivotal elements, for example as a result of an impermissibly high transverse deflection thereof, the lever devices 6, 7 and 8 will also move outside said planes. In that case a centring ring may be useful in order to preclude misalignment of the voice coil (former) in the air gap. Another possibility is to make the plate springs and cross-spring pivots wider, so that the ideal behaviour is approximated more closely and no further centring means are necessary.

In the ideal case, i.e. if the pivotal element exhibits (substantially) no transverse displacement, the compliant element 25, which is constructed as a zigzag bellows and which is secured both to the outer circumference of the diaphragm 1 and to the chassis 26 of the transducer, need not have a centring function but only an air-sealing function. This is to preclude an acoustic short-circuit between the front and rear of the diaphragm 1. Further, the compliant element 25 should allow the large excursion of the diaphragm 1 without impeding the movement of the diaphragm. The operation and the properties of the compliant element 25 will be explained hereinafter with reference to FIGS. 4 and 5. It is evident that conventional compliant elements may be used, provided that they permit the large excursion of the diaphragm 1. With respect to the lever devices 6, 7 and 8 it is to be noted that although in the embodiment shown in FIG. 1 the fulcrum 11 is situated inside a notional extension of the voice-coil former, this fulcrum may alternatively be situated outside the voice-coil former or its notional extension. The fulcrum 11 for the lever device 6 will then be connected to that part of the magnet system which is disposed outside the voice-coil former 2 and the rod 20 will be situated just within the notional extension of the voice-coil former 2.

Figure 2:
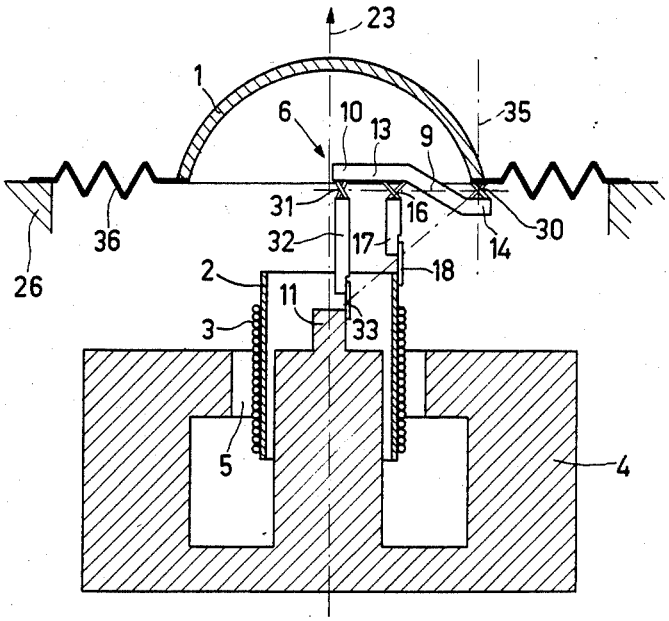
FIG. 2 shows a second embodiment.

FIG. 2 shows a second embodiment of the transducer in accordance with the invention, one of the n lever devices being visible. Parts in FIGS. 1 and 2 bearing the same reference numerals are identical. The lever device 6 again comprises a lever arm 9. The lever arm is coupled to the diaphragm 1 at the location of the third position 14 via a first pivotal element 30, to the voice-coil former 2 at the location of the second position 13 via the second pivotal element 16, the first rod 17 and the third pivotal element 18, and to the fulcrum 11 at the location of the first position 10 via a fourth pivotal element 31, a second rod 32 and a fifth pivotal element 33. Again the pivotal elements may be plate springs or cross-spring pivots. Suitably cross-spring pivots are used for the pivotal elements 16, 30 and 31. The pivotal elements 16, 30 and 31 are disposed in line. The pivotal elements 18, 30 and 33 are also disposed in line. In any deflected position of the diaphragm this results in two similar triangles, one triangle defined by the positions of the pivotal elements 30, 31 and 33 and the other by the positions of the pivotal elements 16, 18 and 30. This results in an exactly linear enlargement of the excursion of the voice-coil former and the excursion of the diaphragm. The diaphragm excursion is effected in a direction corresponding to the direction of the line 35. Therefore, the lever mechanism virtually does not contribute to the distortion in the output signal of the transducer. The diaphragm 1 is constructed as a dome-shaped diaphragm. However other diaphragm shapes are possible, if necessary with a slight modification of the lever device. For example, when driving a flat diaphragm an additional rod should be arranged between the pivotal element 14 and the diaphragm in order to permit both positive and negative excursions of the flat diaphragm. However, an additional rod between the pivotal element 14 and the diaphragm 1 leads to an increase of the moving mass of the system. This is a disadvantage because it reduces the efficiency of the electroacoustic transducer.

From the foregoing it also follows that the efficiency of the transducer with the lever device shown in FIG. 1 is lower than the efficiency of a similar transducer (comprising a similar type of diaphragm) equipped with the lever device shown in FIG. 2. In the embodiment shown in FIG. 1 the second rod 20 performs a translation corresponding to the translation (excursion) of the diaphragm. The moving mass is then substantially equal to the sum of the masses of the diaphragm 1, the second rod 20 and the voice-coil former with the voice coil. In the lever device shown in FIG. 2 there is no rod between the lever arm 9 and the diaphragm 1. Consequently, the moving mass is lower and the efficiency higher. The second rod 32 in FIG. 2 only performs a (very small) rotation and no translation.

Figure 3:
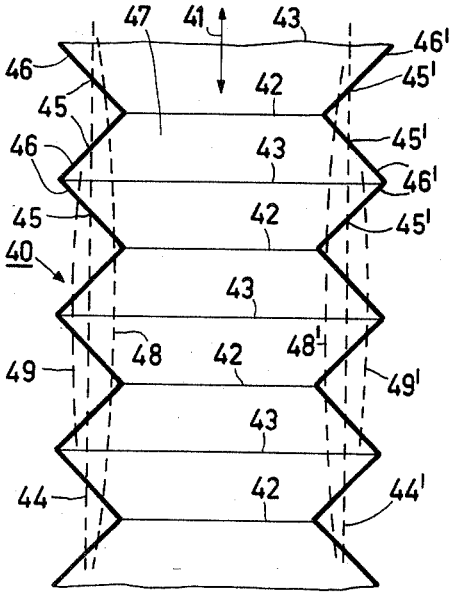
FIG. 3 shows a known zigzag bellows.

In the present case a conventional version is chosen for the compliant element 36 between the outer circumference of the diaphragm 1 and the chassis 26 of the transducer, which compliant element 36 should permit the maximum excursion of the diaphragm. However, such a compliant element is not suitable for very large excursions of the diaphragm. The non-linear behavior of the compliant element, in particular for large excursions, gives rise to a high distortion in the output signal of the transducer. FIG. 3 is a schematic cross-section of the zigzag bellows known from U.S. Pat. No. 3,019,849. However, these known bellows have the disadvantage that they contribute to the acoustic output signal of the transducer. This contribution is undesirable because only the diaphragm should produce the acoustic output signal of the transducer. How the acoustic contribution of the bellows to the output signal of the transducer is produced will be explained with reference to FIG. 3. The cross-section of the bellows 40 in a plane perpendicular to the direction of movement of the diaphragm (in FIG. 3 this direction is indicated by the arrows 41) results in a line. This line is a closed line and it is a circle if the bellows are circular. The length of this line (the circumferential length of the circle) varies when said plane is shifted in a direction corresponding to the arrows 41. Lines of minimum length are designated 42, namely at the location where the bellows are narrowest and lines of maximum length are designated 43, namely at the location where the bellows are widest (or thickest). The broken lines 44 and 44' interconnect the centres (such as 45 and 45') of the sides 46 and 46' respectively of the bellows.

If the bellows shown in FIG. 3 are used in an electroacoustic transducer the space 47 inside the bellows is a space which is enclosed by the bellows wall and further by the diaphragm at the top of the bellows and by the magnet system of the electroacoustic transducer at the bottom.

When the bellows expand in a direction indicated by the arrows 41 as a result of an excursion of the diaphragm (for simplicity it is assumed that as a result of this the bottom of the bellows in FIG. 3 moves downwards and the top of the bellows in FIG. 3 moves upwards and that the centre remains substantially in place) the pressure in the space 47 is reduced. As a result of this, the centres 45 and 45' will not only move in the direction 41 of excursion of the diaphragm but also to the right and the left respectively in the drawing of FIG. 3. The bellows become thinner. In FIG. 3 this is illustrated in that during this expansion of the bellows the broken lines 44 and 44' change to the broken lines 48 and 48', which interconnect the centres 45 and 45' respectively in the expanded condition of the bellows. During a compression of the bellows, however, the pressure in the space 47 will increase. Then the centres 45 and 45' will not only move in the direction 41 of excursion of the diaphragm but also to the left and to the right respectively in FIG. 3. The bellows become thicker. In FIG. 3 this is indicated in that during this compression of the bellows the broken lines 44 and 44' change into the broken lines 49 and 49' which connect the centres 45 and 45' respectively in a compressed condition of the bellows. The result is that the bellows wall radiates an acoustic signal. As already stated in the foregoing, this contribution to the acoustic output signal of the transducer is undesirable.

Figure 4:
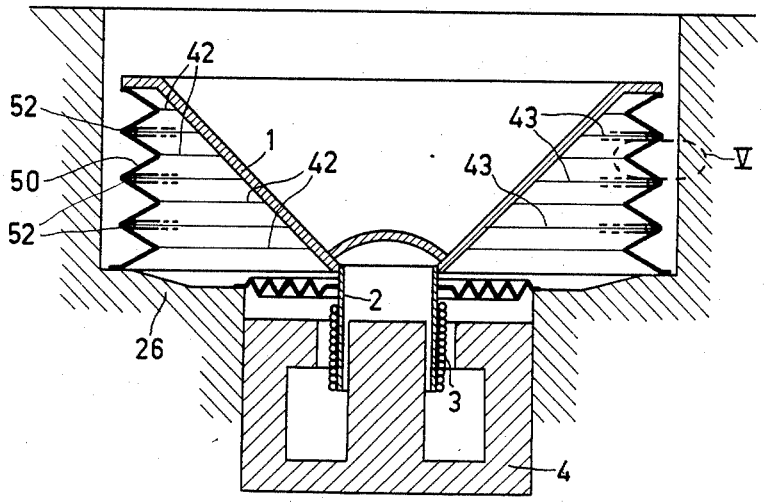
FIG. 4 shows an embodiment of an electroacoustic transducer comprising a zigzag bellows in accordance with the invention, and FIG. 5 schematically shows a part of the zigzag bellows shown in FIG. 4.

FIG. 4 shows an electroacoustic transducer with a zigzag bellows in accordance with the invention in which the acoustic contribution of the bellows is reduced substantially. In accordance with the invention the bellows are provided with stiffening means at the location of a number of identical cross-sections perpendicular to the direction of movement of the diaphragm for keeping these cross-sections at least substantially constant, also during an excursion of the diaphragm. This may for examaple be achieved by providing stiff rings on (in) the bellows. For the bellows shown in FIG. 4 it is the cross-section taken on the line 43 which remain constant, namely the cross-section whose circumferential length in the non-deflected condition of the diaphragm is greatest. In FIG. 4 this is achieved by means of the rings 52. The operation of the bellows is schematically shown in FIG. 5.

Figure 5:
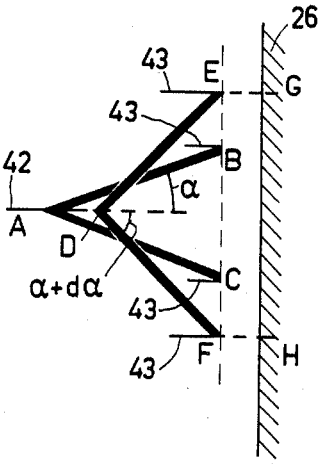

FIG. 5 shows the part of the bellows designated V in FIG. 4. The two successive faces of the bellows formed by the parts of the bellows between the two lines 43 and the one line 42, i.e. the portions of the bellows surface lying on either side of the fold on the line 42 are disposed at an angle of $2\alpha$ relative to each other in a rest condition of the bellows (i.e. in a non-deflected condition of diaphragm). This means that the angle between the portions AB and AC in FIG. 5 is $2\alpha$. In an expanded condition of the bellows the rings are disposed at a greater angle $\beta=2(\alpha+d\alpha)$ relative to each other.

Because of the presence of the stiffening means the circumferential length of the lines 43 is substantially constant regardless of whether the bellows are in the rest condition or in the expanded condition. In FIG. 5 this is indicated in that the points E, B, C and F are disposed in line.

The difference in surface area of the triangle ABC and of the triangle EDF is a measure of the acoustic contribution of the compliant element 50 to the output signal of the transducer. The area of the triangle ABC is $$l^2 \sin \alpha \cos \alpha, \quad (1)$$

and the area of the triangle DEF is $$l^2 \sin (\alpha+d\alpha) \cos (\alpha+d\alpha) \quad (2)$$

so that the difference is $$l^2[\sin (\alpha+d\alpha) \cos (\alpha+d\alpha)-\sin \alpha \cos \alpha]. \quad (3)$$

In the foregoing it has been assumed that the lengths of all the portions AB, AC and DE and DF is l. By differentiating formula (3) to $\alpha$ it is possible to calculate that the contribution of the bellows, i.e. the result of formula (3), is minimal if $\alpha$ is 45°, so that the angle between the two successive faces of the bellows should be 90°. Suitably, depending on the maximum excursion of the diaphragm, the compliant element will be constructed in such a way that for an arbitrary deflected condition of the diaphragm the angle between each pair of successive faces of the bellows is subject to a maximum variation of ±30° relative to 90°. This means that $60° < \beta < 120°$. In this way the acoustic contribution of the bellows can be minimized. Which cross-sections remain constant is actually dictated by the fact that in the transducer shown in FIG. 4 the bellows are secured to the diaphragm 1 and to the chassis 26 along a line of maximum length. During an excursion of the diaphragm the length along which the bellows are secured to the diaphragm and the chassis (in the present case along a line of maximum length) will not change. In the present case the lines 43 are therefore chosen as the lines whose length should be maintained constant even during an excursion. Alternatively, it would be possible to secure the bellows to the diaphragm and to the chassis along a line of minimum length. In that case the stiffening means should be arranged along the lines 42. Generally, however, the bellows may be stiffened also at locations which are disposed between the minimum and maximum cross-sections, provided that all the cross-sections have equal circumferential lengths in the rest condition of the bellows.

The zigzag bellows in accordance with the invention and described in the foregoing with reference to FIG. 5 are generally suitable for use in electroacoustic transducers in order to reduce distortion as a result of the acoustic contribution of the known compliant elements, i.e. also in prior art transducers. Then the construction shown in FIG. 4 is obtained. However, the bellows are particularly suitable for use in electroacoustic transducers with a large excursion, i.e. also in the transducer with the lever mechanism in accordance with the invention as shown in FIG. 1 or 2.

It is to be noted that the invention is not limited to electroacoustic transducers in the embodiments shown. The invention may also be used in electroacoustic transducers which differ from the embodiments shown with respect to points which do not affect the inventive concept.

For example, the invention may also be employed in electromechanical transducers in the form of, for example piezo-ceramic transducers, the electromechanical actuator being a two-layer piezo-ceramic element (bimorph). Such a (circular) element may be clamped in a central portion and may be coupled to a fixed point, for example the transducer chassis. Along the circumference of the piezo-ceramic element two or more lever devices may be arranged, via which the element is coupled to the diaphragm.

What is claimed is

1. An electroacoustic transducer comprising, a diaphragm, an electromechanical actuator, a lever mechanism coupling the electromechanical actuator to the diaphragm for transmitting motion from the electromechanical actuator to said diaphragm, characterized in that the lever mechanism comprises n lever devices with each lever device coupled between the actuator and the diaphragm, the lever devices being arranged at an angle relative to each other, where $n \geqq 2$, said angle being smaller than 180° for $n=2$ and being equal to $360°/n$ for $n \geqq 3$.

2. An electroacoustic transducer as claimed in claim 1 wherein said electromechanical actuator comprises a magnet system and a voice-coil arranged on a voice-coil former so that the voice coil is disposed in an air gap of the magnet system, characterized in that a lever device comprises a lever arm which is coupled to a fulcrum at the location of a first position on the lever arm, to the voice-coil former at the location of a second position on the lever arm, and to the diaphragm at the location of a third position on the lever arm.

3. An electroacoustic transducer as claimed in claim 2 wherein the lever arm is coupled to the fulcrum at the location of the first position via a first pivotal element, to the voice-coil former at the location of the second position via a second pivotal element, a first rod and a third pivotal element, and to the diaphragm at the location of the third position via a fourth pivotal element, a second rod and a fifth pivotal element.

4. A electroacoustic transducer as claimed in claim 2, wherein the lever arm is coupled to the diaphragm at the location of the third position via a first pivotal element, to the voice-coil former at the location of the second position via a second pivotal element, a first rod and a third pivotal element, and to the fulcrum at the location of the first position via a fourth pivotal element, a second rod and a fifth pivotal element.

5. An electroacoustic transducer as claimed in claim 4, wherein the first, the second and the fourth pivotal element are arranged in a line and the first, the third and the fifth pivotal element are arranged in line.

6. An electroacoustic transducer as claimed in claim 3 wherein the pivotal elements are plate springs and/or cross-spring pivots.

7. An electroacoustic transducer as claimed in claim 3 wherein at least the first, the second and the fourth pivotal elements comprise cross-spring pivots.

8. An electroacoustic transducer as claimed in claim 2 wherein the fulcrum is disposed inside the voice-coil former or a notional extension thereof and is coupled to that part of the magnet system which extends within the voice-coil former.

9. An electroacoustic transducer comprising, a diaphragm, a compliant element secured both to the outer circumference of the diaphragm and to a chassis of the transducer, which compliant element takes the form of a zigzag bellows, characterized in that at the location of a number of identical cross-sections perpendicular to the direction of movement of the diaphragm the bellows is provided with stiffening means for keeping said cross-sections at least substantially constant, even during an excursion of the diaphragm.

10. An electroacoustic transducer as claimed in claim 1 characterized in that the transducer further comprises a compliant element secured both to the outer circumference of the diaphragm and to a chassis of the transducer, said compliant element comprising a zigzag bellows, and at the location of a plurality of identical cross-sections perpendicular to the direction of movement of the diaphragm the bellows is provided with stiffening means for keeping said cross-sections at least substantially constant, even during an excursion of the diaphragm.

11. An electroacoustic transducer as claimed in claim 9 wherein the stiffening means are arranged at the location of those cross-sections whose circumferential length is greatest in a non-deflected condition of the diaphragm.

12. An electroacoustic transducer as claimed in claim 9, characterized in that for each fold of the bellows, the portions of the bellows lying on either side thereof are at an angle of $2\alpha$ relative to each other, the said angle being at least substantially equal to 90° in the non-deflected condition of the diaphragm.

13. An electroacoustic transducer as claimed in claim 12, wherein in any deflected condition of the diaphragm the angle which the said two portions make with each other is always between 60° and 120°.

14. An electroacoustic transducer as claimed in claim 10 wherein the stiffening means are arranged at the location of those cross-sections whose circumferential length is greatest in a non-deflected condition of the diaphragm.

15. An electroacoustic transducer as claimed in claim 10, characterized in that for each fold of the bellows, the portions of the bellows lying on either side thereof are at an angle of $2\alpha$ relative to each other, the said angle being at least substantially equal to 90° in the non-deflected condition of the diaphragm.

16. An electroacoustic transducer as claimed in claim 11, characterized in that for each fold of the bellows, the portions of the bellows lying on either side thereof are at an angle of $2\alpha$ relative to each other, the said angle being at least substantially equal to 90° in the non-deflected condition of the diaghragm.

17. An electroacoustic transducer as claimed in claim 14, characterized in that for each fold of the bellows, the portions of the bellows lying on either side thereof are at an angle of $2\alpha$ relative to each other, the said angle being at least substantially equal to 90° in the non-deflected condition of the diaghragm.

18. An electroacoustic transducer as claimed in claim 15 wherein in any deflected condition of the diaphragm the angle which the said two portions make with each other is always between 60° and 120°.

19. An electroacoustic transducer as claimed in claim 16 wherein in any deflected condition of the diaphragm the angle which the said two portions make with each other is always between 60° and 120°.

20. An electroacoustic transducer as claimed in claim 17 wherein in any deflected condition of the diaphragm the angle which the said two portions make with each other is always between 60° and 120°.

21. An electroacoustic transducer comprising, a diaphragm, an electromechanical actuator, a lever mechanism coupling the electromechanical actuator to the diaphragm for transmitting motion from the electromechanical actuator to said diaphragm, characterized in that the lever mechanism comprises n lever devices with each lever device coupled between the actuator and the diaphragm, the lever devices being arranged at an angle relative to each other, where $n \geqq 2$ and said angle is equal to $360°/n$ when $n \geqq 3$.

22. An electroacoustic transducer as claimed in claim 1 wherein $n=2$ and said angle is 90°.

* * * * *

UNITED STATES PATENT AND TRADEMARK OFFICE

CERTIFICATE OF CORRECTION

PATENT NO. : 4,547,631

DATED : October 15, 1985

INVENTOR(S) : JORIS A.M. NIEUWENDIJK ET AL

It is certified that error appears in the above-identified patent and that said Letters Patent is hereby corrected as shown below:

In the Abstract

Line 18, after "(25)" insert --,-- (comma)

In the Specification

Column 4, after "line 51" insert new line

--FIG. 1d shows an electroacoustic transducer where n=2,--

In the Claims:

Claim 4, line 1, change "A" to --An--

Signed and Sealed this

Fourth Day of March 1986

[SEAL]

Attest:

DONALD J. QUIGG

Attesting Officer

Commissioner of Patents and Trademarks